US006095750A

United States Patent [19]

Ross et al.

[11] Patent Number: 6,095,750

[45] Date of Patent: Aug. 1, 2000

[54] TURBINE NOZZLE ASSEMBLY

[75] Inventors: Steven A. Ross, Cincinnati, Ohio; Robert J. Albers, Park Hills, Ky.; Edward P. Brill, West Chester, Ohio; Andrew D. Kemp, Loveland, Ohio; Larry W. Plemmons, Hamilton, Ohio

[73] Assignee: General Electric Company, Cincinnati, Ohio

[21] Appl. No.: 09/217,660

[22] Filed: Dec. 21, 1998

[51] Int. Cl.[7] ..... F01D 9/04

[52] U.S. Cl. ..... 415/189; 415/115; 415/174.4; 415/174.5; 415/209.2; 415/209.3; 415/209.4; 60/39.32

[58] Field of Search ..... 415/189, 190, 415/209.2, 209.3, 209.4, 136, 138, 139, 115, 116, 173.4, 173.5, 173.7, 174.4, 174.5; 416/95, 96 R, 96 A, 97 R; 60/39.31, 39.32

[56] References Cited

U.S. PATENT DOCUMENTS

| | | | |
|---|---|---|---|
| 3,635,586 | 1/1972 | Kent et al. | 416/97 R |
| 3,768,924 | 10/1973 | Corsmeier et al. | 416/95 |
| 3,989,410 | 11/1976 | Ferrari | 415/115 |
| 4,426,191 | 1/1984 | Brodell et al. | 415/189 |
| 4,730,978 | 3/1988 | Baran, Jr. | 415/115 |
| 4,805,398 | 2/1989 | Jourdain et al. | 415/116 |
| 5,143,512 | 9/1992 | Corsmeier et al. | 415/115 |
| 5,205,706 | 4/1993 | Belcher | 415/174.5 |
| 5,211,536 | 5/1993 | Ackerman et al. | 415/209.3 |
| 5,222,742 | 6/1993 | Roberts | 415/174.5 |
| 5,224,822 | 7/1993 | Lenahan et al. . | |
| 5,271,714 | 12/1993 | Shepherd et al. | 415/209.2 |
| 5,372,476 | 12/1994 | Hemmelgarn et al. . | |
| 5,402,636 | 4/1995 | Mize et al. | 415/173.7 |
| 5,984,630 | 11/1999 | Di Salle et al. | 415/174.5 |

*Primary Examiner*—Christopher Verdier
*Attorney, Agent, or Firm*—Andrew C. Hess; Nathan D. Herkamp

[57] ABSTRACT

A turbine nozzle assembly includes a plurality of nozzle segments and a nozzle support for supporting the nozzle segments. Each nozzle segment includes an outer band, an inner band and at least two vanes disposed between the outer and inner bands. A retention flange extends radially inwardly from the inner band and has a first hole formed therein. The nozzle support includes a recess formed therein and a mounting flange extending therefrom. The mounting flange is disposed in contact with the retention flange and has a second hole formed therein. A pin is disposed in the first and second holes to position the flanges with respect to one another. A pin retainer is disposed in the recess and has a holding flange for retaining the pin in place. The nozzle support includes a substantially conical portion and an air seal integrally formed thereto.

20 Claims, 3 Drawing Sheets

TURBINE NOZZLE ASSEMBLY

BACKGROUND OF THE INVENTION

This invention relates generally to turbine nozzle assemblies for gas turbine engines and more particularly to inner support structure for turbine nozzle assemblies.

A gas turbine engine includes a compressor that provides pressurized air to a combustor wherein the air is mixed with fuel and ignited for generating hot combustion gases. These gases flow downstream to one or more turbines that extract energy therefrom to power the compressor and provide useful work such as powering an aircraft in flight. Aircraft engines typically include a stationary turbine nozzle disposed at the outlet of the combustor for channeling combustion gases into the turbine rotor disposed downstream thereof. The turbine nozzle must direct the combustion gases in such a manner that the turbine blades can do work. Therefore, proper positioning of the turbine nozzle is needed for the turbine to produce optimal work. However, the turbine nozzle is subject to differential thermal expansion with adjoining components due to the highly heated combustion gases. This can lead to undesirable thermally induced stresses in the turbine nozzle.

Accordingly, turbine nozzle assemblies must be designed to accommodate the thermal loading. This includes mounting arrangements that allow the nozzles to freely expand circumferentially and radially while maintaining proper positioning. Turbine nozzles are typically segmented around the circumference thereof with each nozzle segment having one or more nozzle vanes. Suitable seals are provided between adjacent nozzle segments. Each segment is supported by a stationary nozzle support which allows limited relative movement of the nozzle segments to accommodate the differential thermal expansion and contraction of adjacent components. The nozzle support also supports the inner liner of the combustor, which is attached to the nozzle support by a number of bolts. During operation of the engine, the flow of combustion gases exerts an axially aft force on the nozzle segments to firmly press the nozzle segments against the nozzle support at their radially inner ends. The radially outer ends of the segments are pressed against a conventional shroud hanger disposed downstream therefrom. However, suitable means must be provided to hold the nozzle segments in place when the combustion gases do not provide sufficient axial force to firmly hold the nozzle segments in place.

In many conventional configurations, the inner band of a nozzle segment is directly bolted to the nozzle support. Such arrangements can create stresses in the nozzle segments and support due to differential thermal expansion and contraction. Furthermore, these designs use costly fasteners and bolted flanges and increase assembly and disassembly time.

In addition to supporting the nozzle segments and the combustor liner, the turbine nozzle assembly includes structure to supply cooling air to various areas of the turbine. Part of this structure includes a stationary air seal that is bolted to the aft end of the nozzle support. Air seals in conventional turbine nozzle assemblies must be removable in order to provide access to the bolts that attach the combustor liner to the nozzle assembly. This arrangement also increases the overall quantity and complexity of the hardware.

Accordingly, there is a need for a turbine nozzle assembly having support structure that accommodates differential thermal expansion and maintains proper nozzle position without the use of costly, time-consuming threaded fasteners.

SUMMARY OF THE INVENTION

The above-mentioned needs are met by the present invention which provides a turbine nozzle assembly including a plurality of nozzle segments and a nozzle support supporting the nozzle segments. Each nozzle segment includes an outer band, an inner band and at least two vanes disposed between the outer and inner bands. A retention flange extends radially inwardly from the inner band and has a first hole formed therein. The nozzle support includes a recess formed therein and a mounting flange extending therefrom. The mounting flange is disposed in contact with the retention flange and has a second hole formed therein. A pin is disposed in the first and second holes to radially and circumferentially position the flanges with respect to one another. A pin retainer is disposed in the recess and has a holding flange for retaining the pin in place. The nozzle support includes a substantially conical portion and an air seal integrally formed thereto.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
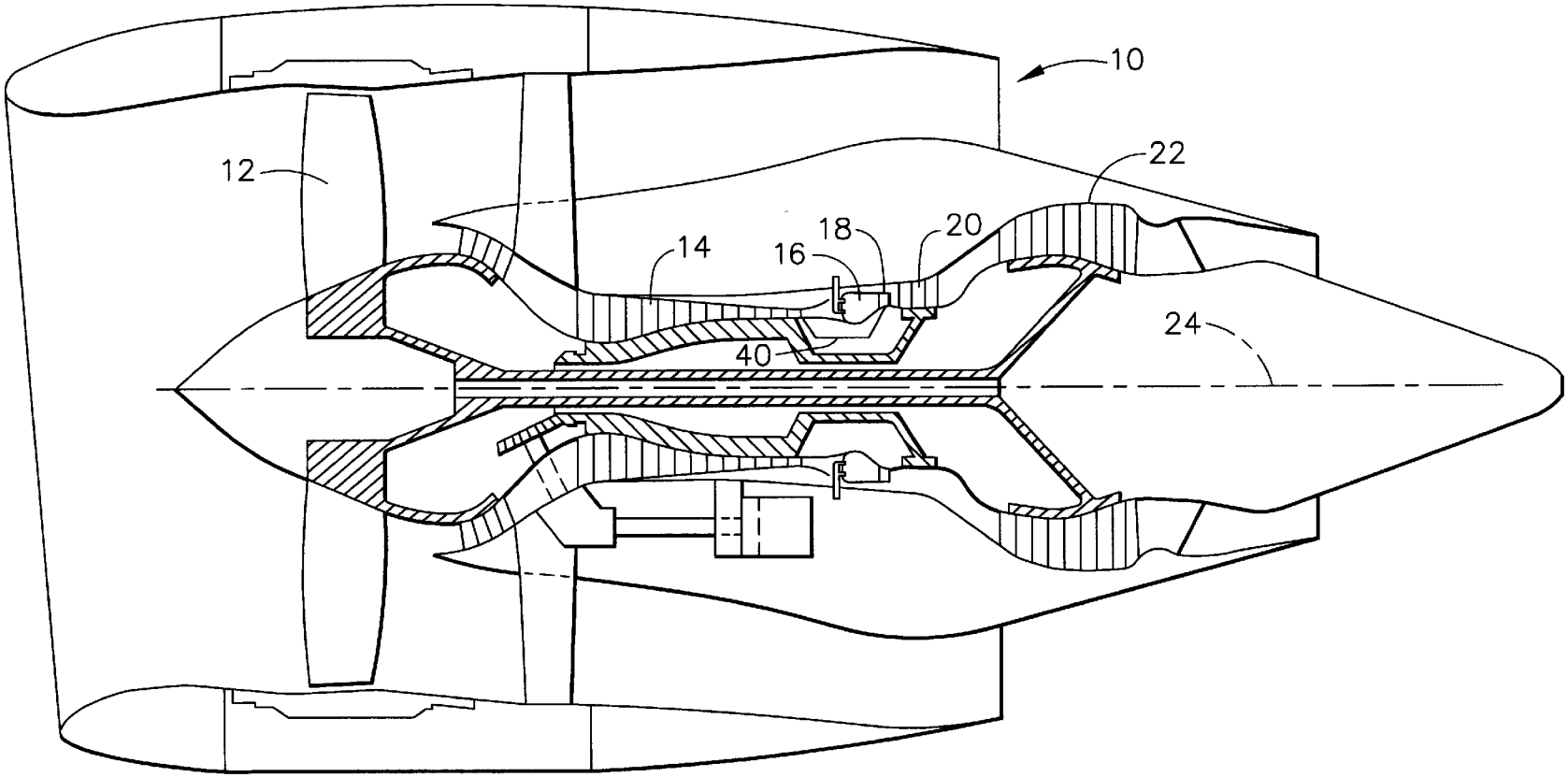
FIG. 1 is a schematic, longitudinal sectional view of an exemplary turbofan gas turbine engine having the turbine nozzle assembly of the present invention.

Referring to the drawings wherein identical reference numerals denote the same elements throughout the various views, FIG. 1 shows an exemplary turbofan gas turbine engine 10 having in serial flow communication a conventional fan 12, a high pressure compressor 14, and a combustor 16. The combustor 16 conventionally generates combustion gases that are discharged therefrom through a high pressure turbine nozzle assembly 18 from which the combustion gases are channeled to a conventional high pressure turbine 20 and in turn to a conventional low pressure turbine 22. The high pressure turbine 20 drives the high pressure compressor 14 through a suitable shaft, and the low pressure turbine drives the fan 22 through another suitable shaft, all disposed coaxially about a longitudinal or axial centerline axis 24.

Figure 2:
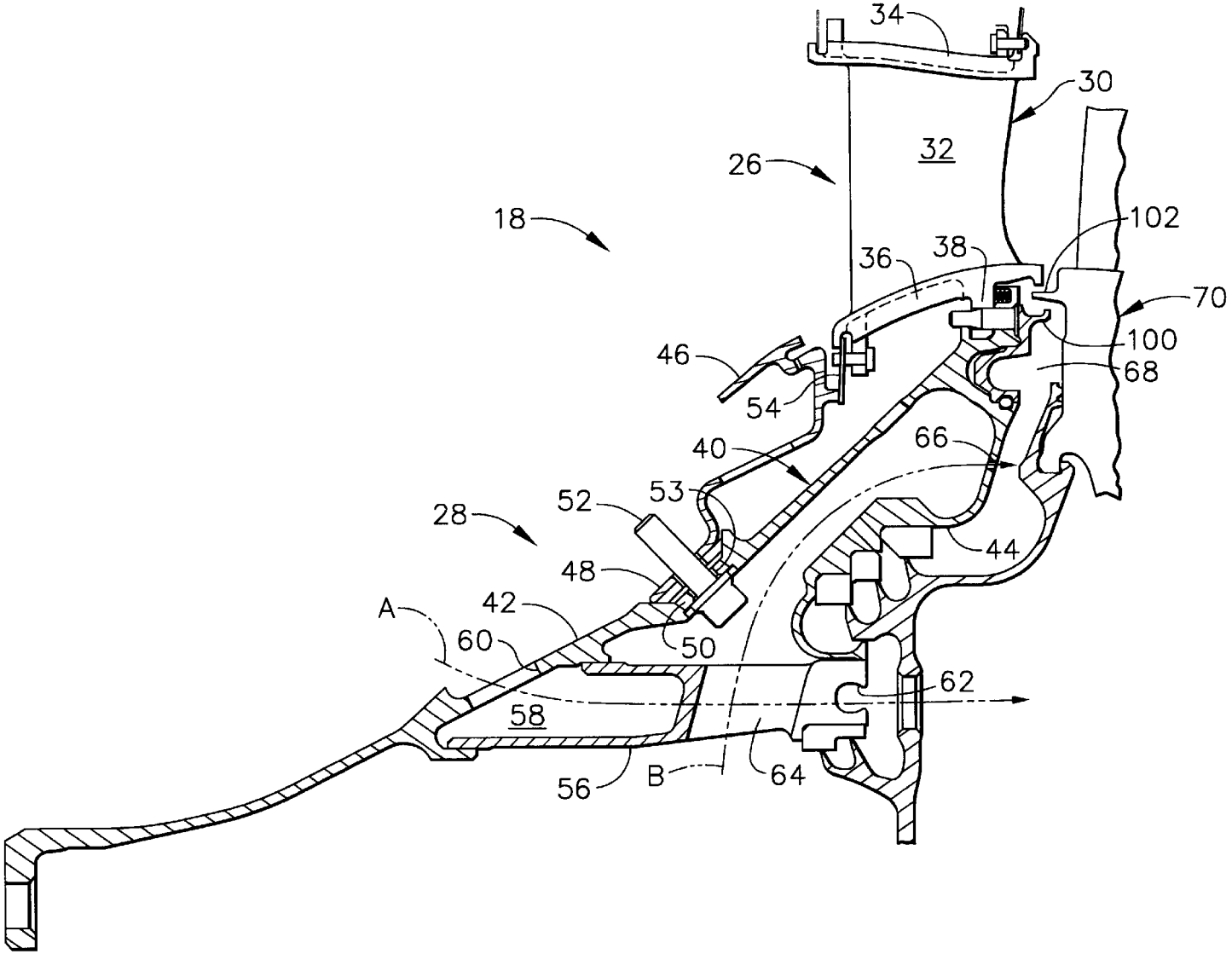
FIG. 2 is a sectional view of the turbine nozzle assembly of the present invention.

Referring now to FIG. 2, the turbine nozzle assembly 18 is shown in more detail. The turbine nozzle assembly 18 includes a turbine nozzle 26 and a nozzle support assembly 28. The turbine nozzle 26 preferably includes a plurality of circumferentially adjoining nozzle segments 30 collectively forming a complete 360° assembly. Each segment 30 has two or more circumferentially spaced vanes 32 (one shown in FIG. 2), each having an upstream leading edge and a downstream trailing edge, over which the combustion gases flow. Each segment 30 also includes an arcuate radially outer band 34 and an arcuate radially inner band 36 between which the vanes 32 are attached. The inner band 36 includes a retention flange 38 extending radially inwardly therefrom near the aft end of the inner band 36. Preferably, the retention flange 38 is integral with the inner band 36 and extends circumferentially for the full arcuate extent of the inner band 36.

The nozzle support assembly 28 includes an inner nozzle support 40 to which the nozzle segment 30 is mounted. The inner nozzle support 40 is a stationary member suitably supported in the engine 10 and includes a substantially conical portion 42. The nozzle segment 30 is mounted to the axially and radially distal end of the conical portion 42. The inner nozzle support 40 also includes an annular stationary air seal 44, which is integrally formed to the axially and radially distal end of the conical portion 42 and extends radially inwardly. In addition to supporting the turbine nozzle 26, the inner nozzle support 40 also supports the inner liner 46 of the combustor 16. Specifically, a mounting flange 48 formed on the inner liner 46 is bolted to an abutment 50 formed on the conical portion 42 by a plurality of bolts 52 received in bolt holes 53 formed in the abutment 50. A seal 54 is disposed between the inner liner 46 and the forward end of the inner band 36 to prevent ingress of hot combustion gases or escape of cooling air.

The nozzle support assembly 28 also includes an accelerator 56 disposed between the conical portion 42 and the air seal 44. The accelerator 56 is an annular member which defines an internal air plenum 58. High pressure cooling air (represented by arrow A) is fed to the plenum 58 via air holes 60 formed in the conical portion 42 of the inner nozzle support 40. The high pressure cooling air passes axially through the accelerator 56 and is discharged therefrom through a plurality of accelerator nozzles 62 formed in the aft end of the accelerator 56 for cooling high pressure turbine blades downstream of the turbine nozzle assembly 18. The accelerator 56 also includes a plurality of hollow tubes 64 extending radially through the air plenum 58 so as not to permit fluid communication therewith. Low pressure cooling air (represented by arrow B) passes radially through the hollow tubes 64 and then through bleed holes 66 formed in the air seal 44 to purge the forward wheel cavity 68 between the turbine nozzle assembly 18 and the turbine rotor disk 70.

The hollow tubes 64 are circumferentially aligned with the bolts 52 and bolt holes 53 that attach the inner combustor liner 46 to the conical portion 42 of the inner nozzle support 40. The hollow tubes 64 are also sized to permit access to assemble and torque the bolts 52. This eliminates the need for a removable air seal, thus allowing air seal 44 to be integrally formed to the conical portion 42, thereby reducing the quantity and complexity of hardware.

Figure 3:
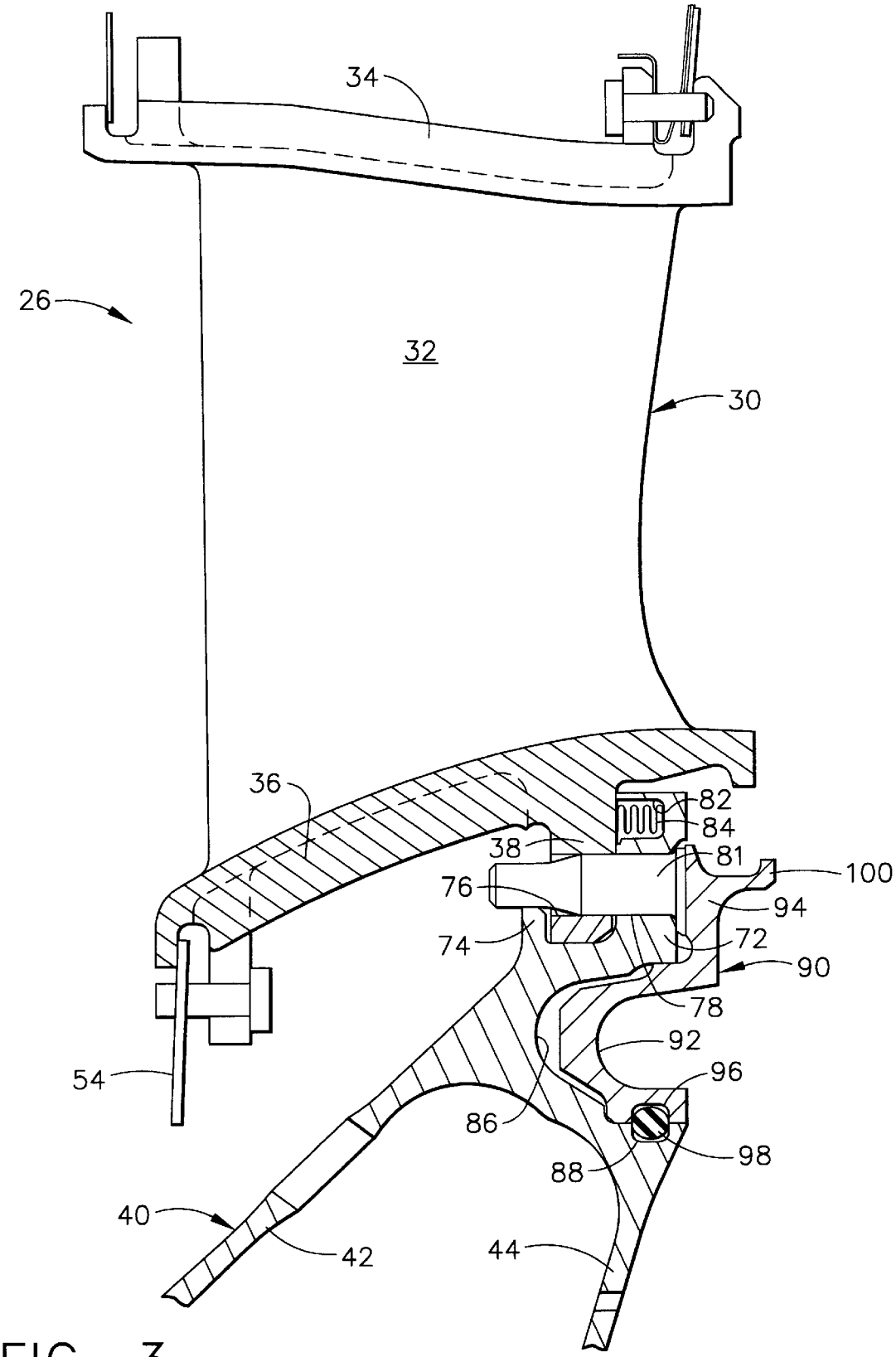
FIG. 3 is an enlarged sectional view of the turbine nozzle assembly of FIG. 1.

Turning to FIG. 3, the arrangement for mounting the turbine nozzle 26 to the inner nozzle support 40 is shown in more detail. The inner nozzle support 40 has, at its axially and radially distal end thereof, an annular radially outwardly extending aft mounting flange 72 formed thereon. An annular radially outwardly extending forward mounting flange 74 is formed on the inner nozzle support 40 just forward of the aft mounting flange 72 so as to define a gap therebetween. The retention flange 38 formed on the inner band 36 of the nozzle segment 30 is disposed between the aft mounting flange 72 and the forward mounting flange 74. Thus, the inner nozzle support 40 positions the nozzle segment 30 axially by virtue of the flow of combustion gases pressing the retention flange 38 against the aft mounting flange 72. The forward mounting flange 74 is provided to prevent forward movement of the nozzle segment 30 in the unlikely event of an engine stall.

The retention flange 38 has a hole 76 formed therein, and the aft mounting flange 72 has a hole 78 formed therein for receiving a pin 80. The pin 80 is inserted from the aft side of the aft mounting flange 72 through the hole 78 and then through the hole 76 to accurately position the nozzle segment 30 radially and circumferentially. As shown in FIG. 3, the pin 80 extends past the outer radial edge of the forward mounting flange 74. Alternatively, the forward mounting flange 74 could extend further in the radial direction, in which case, it would be provided with a hole formed therein to receive the pin 80. A slot 82 is formed in the forward surface of the aft mounting flange 72, near its radially outermost tip. A W-seal 84 is disposed in the slot 82 so as to abut the retention flange 38.

An aft-facing recess 86 is formed in the inner nozzle support 40, radially inward from the aft mounting flange 72, and a first slot 88 is formed in the recess 86. Disposed in recess 86 is a pin retainer 90 that retains the pin 80 in the holes 76 and 78. The pin retainer 90 includes a U-shaped body portion 92 having two legs and a holding flange 94 extending radially outward from, and perpendicularly to, one of the legs of the U-shaped body portion 92. The other leg of the U-shaped body portion 92 has a second slot 96 formed therein. The body portion 92 is forced into the recess 86 using an assembly fixture such that the two legs of the U-shaped body portion 92 extend in an axial direction and the first and second slots 88 and 96 are aligned with one another. With the slots 88 and 96 aligned, a lock wire 98 is inserted into the slots 88 and 96. Thus, when the fixture is removed, the lock wire 98 holds the pin retainer 90 in the recess 86. With the pin retainer 90 so positioned, the holding flange 94 presses against the head 81 of the pin 80, thereby retaining the pin 80 in place. The pin retainer 90 also includes an angel wing 100 extending axially aft from the holding flange 94. As best shown in FIG. 2, the angel wing 100 overlaps with a similar angle wing 102 on turbine rotor 70 in a conventional manner.

The foregoing has described a turbine nozzle assembly that supports the turbine nozzle and the combustor liner with fewer pieces of hardware, including fewer fasteners. While specific embodiments of the present invention have been described, it will be apparent to those skilled in the art that various modifications thereto can be made without departing from the spirit and scope of the invention as defined in the appended claims.

What is claimed is:

1. A turbine nozzle assembly comprising:

a plurality of nozzle segments, each nozzle segment including a retention flange, said retention flange having a first hole formed therein;

a nozzle support supporting said plurality of nozzle segments, said nozzle support having a recess formed therein and a mounting flange, said mounting flange being disposed in contact with said retention flange and having a second hole formed therein;

a pin disposed in said first and second holes; and a pin retainer having two legs disposed in said recess, said pin retainer being in contact with said pin.

2. The turbine nozzle assembly of claim 1 wherein each nozzle segment comprises an outer band, an inner band and at least two vanes disposed between said outer band and said inner band, said retention flange extending radially inwardly from said inner band.

3. The turbine nozzle assembly of claim 1 wherein said mounting flange is located aft of said retention flange.

4. The turbine nozzle assembly of claim 3 further comprising a second mounting flange formed on said nozzle support and located forward of said retention flange.

5. The turbine nozzle assembly of claim 1 wherein said nozzle support includes a substantially conical portion and an air seal integrally formed to said substantially conical portion.

6. The turbine nozzle assembly of claim 5 further comprising a plurality of bolt holes formed in said substantially conical portion for bolting a combustor liner thereto.

7. The turbine nozzle assembly of claim 6 further comprising an accelerator disposed between said substantially conical portion and said air seal, said accelerator including an internal air plenum and a plurality of tubes extending radially through said Internal air plenum, wherein said tubes are circumferentially aligned with said bolt holes.

8. The turbine nozzle assembly of claim 1 wherein said pin retainer includes a holding flange extending perpendicularly from one of said legs, said holding flange being in contact with said pin.

9. The turbine nozzle assembly of claim 1 wherein said recess has a first slot formed therein and one of said legs has a second slot formed therein, and further comprising a lock wire disposed in said first and second slots.

10. The turbine nozzle assembly of claim 8 further comprising an angel wing extending axially from said holding flange.

11. The turbine nozzle assembly of claim 8 wherein said two legs extend in an axial direction.

12. A turbine nozzle assembly comprising:

a plurality of nozzle segments, each nozzle segment including a retention flange, said retention flange having a first hole formed therein;

a nozzle support supporting said plurality of nozzle segments, said nozzle support having a recess formed therein and a mounting flange, said recess having a first slot formed therein and said mounting flange being disposed in contact with said retention flange and having a second hole formed therein;

a pin disposed in said first and second holes;

a pin retainer including a U-shaped body portion having two legs and a holding flange extending from one of said legs, one of said legs having a second slot formed therein and said two legs being disposed in said recess and said holding flange being in contact with said pin; and a lock wire disposed in said first and second slots.

13. The turbine nozzle assembly of claim 12 wherein each nozzle segment comprises an outer band, an inner band and at least two vanes disposed between said outer band and said inner band, said retention flange extending radially inwardly from said inner band.

14. The turbine nozzle assembly of claim 12 wherein said mounting flange is located aft of said retention flange.

15. The turbine nozzle assembly of claim 14 further comprising a second mounting flange formed on said nozzle support and located forward of said retention flange.

16. The turbine nozzle assembly of claim 12 wherein said nozzle support includes a substantially conical portion and an air seal integrally formed to said substantially conical portion.

17. The turbine nozzle assembly of claim 16 further comprising a plurality of bolt holes formed in said substantially conical portion for bolting a combustor liner thereto.

18. The turbine nozzle assembly of claim 17 further comprising an accelerator disposed between said substantially conical portion and said air seal, said accelerator including an internal air plenum and a plurality of tubes extending radially through said internal air plenum, wherein said tubes are circumferentially aligned with said bolt holes.

19. The turbine nozzle assembly of claim 12 wherein said two legs extend in an axial direction and said holding flange extends perpendicularly from said one of said legs.

20. The turbine nozzle assembly of claim 12 further comprising an angel wing extending axially from said holding flange.

* * * * *